US005548931A

United States Patent [19]

Bryant

[11] Patent Number: 5,548,931

[45] Date of Patent: Aug. 27, 1996

[54] QUICK CLEANING GUTTER SYSTEM

[76] Inventor: Johnnie J. Bryant, 3606 Rocky Ln., Little Rock, Ark. 72210

[21] Appl. No.: 367,870

[22] Filed: Jan. 3, 1995

[51] Int. Cl.[6] ..... E04D 13/06

[52] U.S. Cl. ..... 52/11; 52/16; 52/12; 248/48.2

[58] Field of Search ..... 52/11, 12, 13, 52/14, 15, 16; 210/474, 482, 459, 499, 497.01; 248/48.1, 48.2

[56] References Cited

U.S. PATENT DOCUMENTS

| | | | |
|---|---|---|---|
| 1,061,151 | 12/0977 | Ward . | |
| 3,611,731 | 10/1971 | Edmondson | 52/11 X |
| 3,913,284 | 10/1975 | Hall | 52/11 |
| 4,116,008 | 9/1978 | Ward . | |
| 4,117,635 | 10/1978 | Helson | 52/16 X |
| 4,190,988 | 3/1980 | Carreiro | 52/11 X |
| 4,257,716 | 3/1981 | Woodrow | 52/11 X |
| 4,411,108 | 10/1983 | Kerester | 248/48.2 X |
| 4,634,312 | 1/1987 | Sterzel | 52/11 X |
| 4,709,516 | 12/1987 | Gleaves | 52/11 |
| 4,807,406 | 2/1989 | Densmore | 52/12 X |
| 5,184,435 | 2/1993 | Sherman . | |
| 5,274,965 | 1/1994 | Jackson . | |
| 5,335,460 | 8/1994 | Smith, Jr. | 248/48.2 X |
| 5,437,138 | 8/1995 | Tuohey et al. | 248/48.2 X |

*Primary Examiner*—Wynn E. Wood

*Attorney, Agent, or Firm*—Stephen D. Carver; Trent C. Keisling

[57] ABSTRACT

A quick cleaning gutter system that attaches to the fascia of a building to collect and channel water from the roof to the building base. A shelf prevents damage to the gutter system. The gutter comprises several independently rotatable channels that are supported by several fixtures. The channels form a downwardly sloping liquid flow path. Rotatable connectors seal the junctures between the channels. The channels periodically intersect downspouts that redirect the water downwardly into drains. The downspouts may also be attached to the channels by connectors to facilitate channel rotation. The downspouts may be fixed or rotatable. The fixtures comprise a bracket assembly that captivates a rotatable inner collar. Preferably, a tongue and groove captivates the collar within the bracket assembly while permitting collar rotation. The collars revolve to rotate the channels. Spaced apart actuating cables extend from selected fixtures. Each cable is entrained about the collar within an internal channel defined on the collar periphery. A tab secures an end of the cable. In operation, the user manipulates the gutter by grasping the cable and forcefully pulling it. This motion rotates the channels. The channels have a bead formed along their upper, exterior edge to accumulate debris during initial rotation. Rotation ceases abruptly when a tab contacts the cable, and accumulated debris is expelled outwardly from the gutters in response to shock.

13 Claims, 12 Drawing Sheets

QUICK CLEANING GUTTER SYSTEM

BACKGROUND OF THE INVENTION

I. Field of the Invention

This invention relates generally to user manipulatable gutters or drain troughs for buildings. More particularly, this invention relates to gutters that a user may forcefully tilt to expel debris while the user remains on the ground.

II. Description of the Prior Art

Gutters are well known in the roofing, construction and building maintenance industries. Gutters are commonly used to channel water from the roof of a building to the ground in a systematic and controlled manner.

Conventional gutters line the edges of the building roof. The gutters collect and convey water to downspouts. The downspouts redirect the water downwardly into a drain pipe. The drain pipe empties the collected water at ground level. Thus, the water flows from the building roof to the base in a controlled manner that does not harm the building or its surroundings.

A problem associated with the use of conventional gutters is that they often become blocked or filled by debris. Gutters often collect pine needles, leaves, shingle debris, nuts, twigs and other materials. These substances are commonly deposited on roofs by overhanging trees, birds or the wind. Gutters become jammed when debris is washed off the roof and into the gutter by falling rain or melting snow or ice.

Clogged gutters do not perform satisfactorily. The deposited debris accumulates in the gutters, downspouts and the drain pipes. This accumulated debris prevents the water from flowing and exiting the gutter system properly. Eventually, the gutter fills and water spills over the sides of the gutter.

Therefore, a reliable method of cleaning gutters is necessary.

Several prior art devices have attempted to deal effectively with the problems associated with cleaning gutters. These devices may be grouped into two broad categories, tiltable gutters and tools for cleaning gutters.

Some tools for cleaning gutters require the user to climb upon the roof of the building to clean the gutter. U.S. Pat. No. 4,194,780 is designed to remove debris from gutters. However, it is dangerous for users to climb upon roofs or to try and clean the gutters from a ladder.

Other tools permit the user to remain upon the ground while raking or moving or pushing some device through the gutter to remove debris therefrom. Examples of these types of tools are seen in U.S. Pat. Nos. 4,196,927 and 4,310,940. However, these tools must be properly manipulated from the ground to effectively clean the gutters. The operator must also avoid hangers or fixtures placed at regular intervals along the length of the gutter. Such ground operated cleaning devices are often costly and difficult to operate. It is difficult for an operator to effectively clean a gutter without being able to watch the tool in action.

The other category of devices are tiltable gutters. Examples of this type of device are seen in U.S. Pat. Nos. 4,807,406, 4,837,987, 4,669,232 and 4,745,657. These types of devices generally provide for the tiltable mounting of the gutter. To clean the gutter, the operator manipulates the gutter to tilt it to empty the debris therefrom.

Several problems are associated with the use of these prior art devices. Most prior art devices are constructed from metal parts that tend to rust in the gutter environment. Some prior art tiltable gutters rely upon auxiliary tools to tip and straighten the gutters. These tools are easily lost or misplaced and may also present hazards in and of themselves when used near electrical power lines. A problem the prior art fails to address is the path of the dumped debris. The prior art tiltable gutters simply dump the debris straight down, often upon the operator.

Therefore, it would be desirable to provide a tiltable gutter which avoids the problems associated with the prior art. A desirable gutter would be easily and economically assembled out of existing, conventional plastic components. An improved gutter system would also need to be flexible to accommodate various configurations at the job site and lightweight to ease installation. A plastic gutter system would require no rust prevention nor would it require lubrication to perform tilting operations.

An ideal gutter system would not require the operator to retain separate tools to tilt or clean the gutters. The improved system would permit the operator to manipulate the gutter to expel the debris in an arc away from the building base. This would facilitate the easy clean up of the debris while also preventing the debris from bombarding the operator.

SUMMARY OF THE INVENTION

The present invention comprises a quick cleaning gutter system for use on buildings. A plastic gutter system attaches to the facia of a building to collect and channel water from the roof to the base of the building.

The gutter comprises several independently rotatable pipes that are supported by several fixtures. The plastic pipes are glued or otherwise attached to the interior of the fixtures. The pipes form a downwardly sloping channel for the flow of the collected water. Rotatable connectors seal the junctures between the pipes.

The pipes periodically intersect downspouts that redirect the water flow downwardly into drains. The downspouts are also attached to the pipes by connectors that permit the pipes to rotate. The downspouts may be fixed or they may rotate with the pipes.

The fixtures comprise a bracket assembly that captivates a rotatable inner collar. The pipes are directly attached to the inner surfaces of the collar. Preferably, a tongue and groove captivates the collar while permitting rotary movement. The collars are rotated within the fixtures to impart rotation to the pipes.

Periodically, a cable extends from a supportive fixture to the ground. The cable is entrained about the collar captivated in the fixture. The cable encircles an internal channel defined on the collar. The internal channel ends with a tab used to secure the cable.

In operation, the user manipulates the gutter by grasping the rope and forcefully pulling it. This motion rotates the pipes. The pipes have a bead formed along their upper, exterior edge to accumulate debris during the initial pipe rotation. When the rotation is abruptly ceased, the debris is propelled outwardly from the gutters in an arcuate path because of the centripetal and centrifugal forces associated with the pipe rotation. The expelled debris falls to the ground away from the building base where it may be easily collected for subsequent disposal.

Thus, a basic object of the present invention to provide a quick-cleaning gutter system.

A related object of the present invention is to protect the operator during gutter cleansing operations.

Another basic object is to provide a simple, lightweight, rust-proof, tiltable gutter system.

Another basic object of the present invention to provide an improved, tilting or rotatable gutter system that may be efficiently manipulated by an operator while remaining on the ground.

Another related object is to expel debris from the gutter system in a manner that facilitates subsequent debris collection and removal.

A related object of the present invention is to provide a gutter system which requires a minimum amount of maintenance.

Another basic object is to provide a gutter system wherein the interior rotary elements are protected from the environment.

A related object of the present invention is to provide a gutter system wherein the gutter sections are independently rotatable.

Another related object of the present invention is to provide a fluid flow path that is uninterrupted by adjacent, independently rotatable sections.

Another basic object is to prevent the destruction of gutters because of excessive snow and ice accumulation therein.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
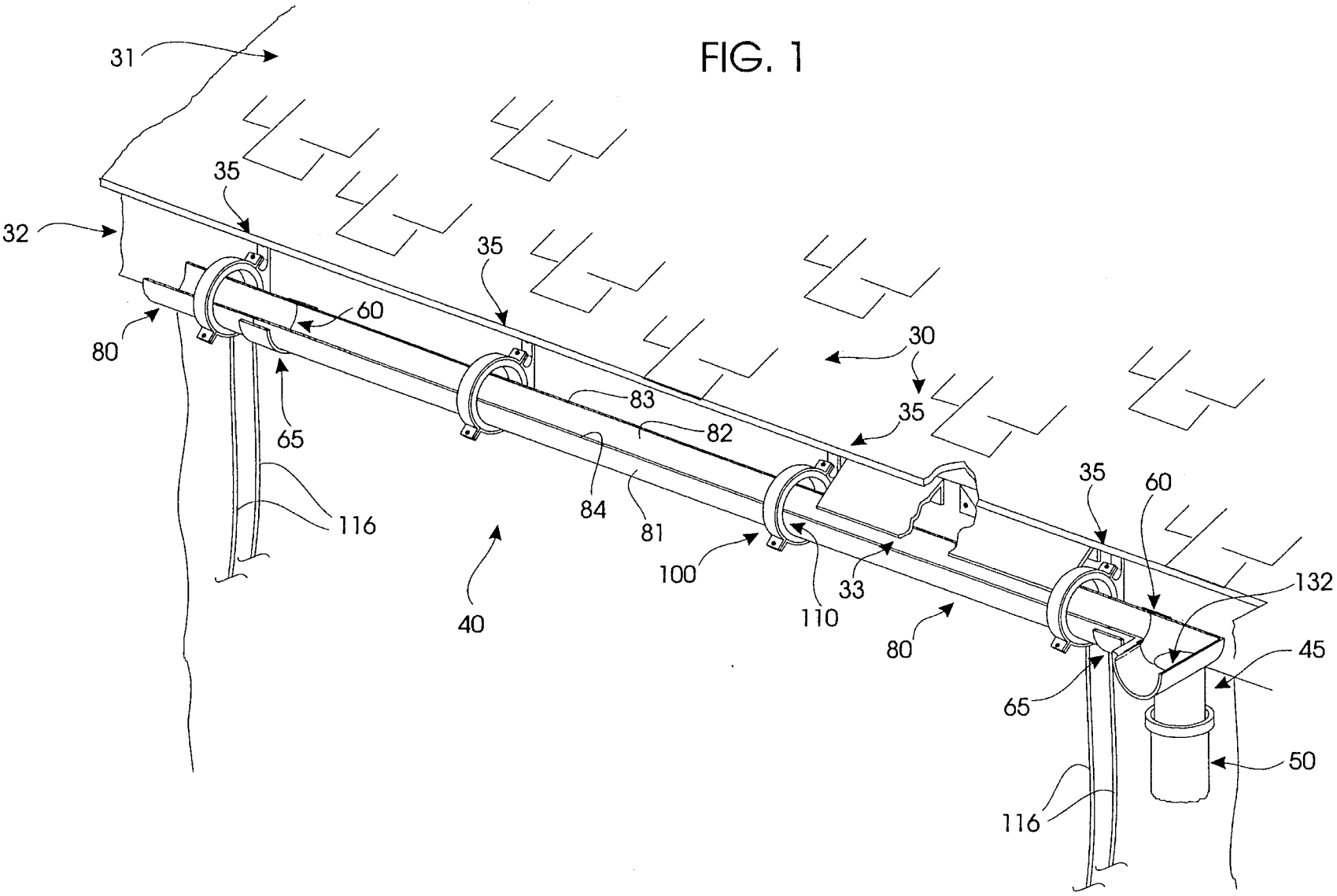
FIG. 1 is a fragmentary environmental, perspective view of the best mode of my Quick Cleaning Gutter System installed upon the roof of a building, with portions broken away or omitted for clarity.
Figure 2:
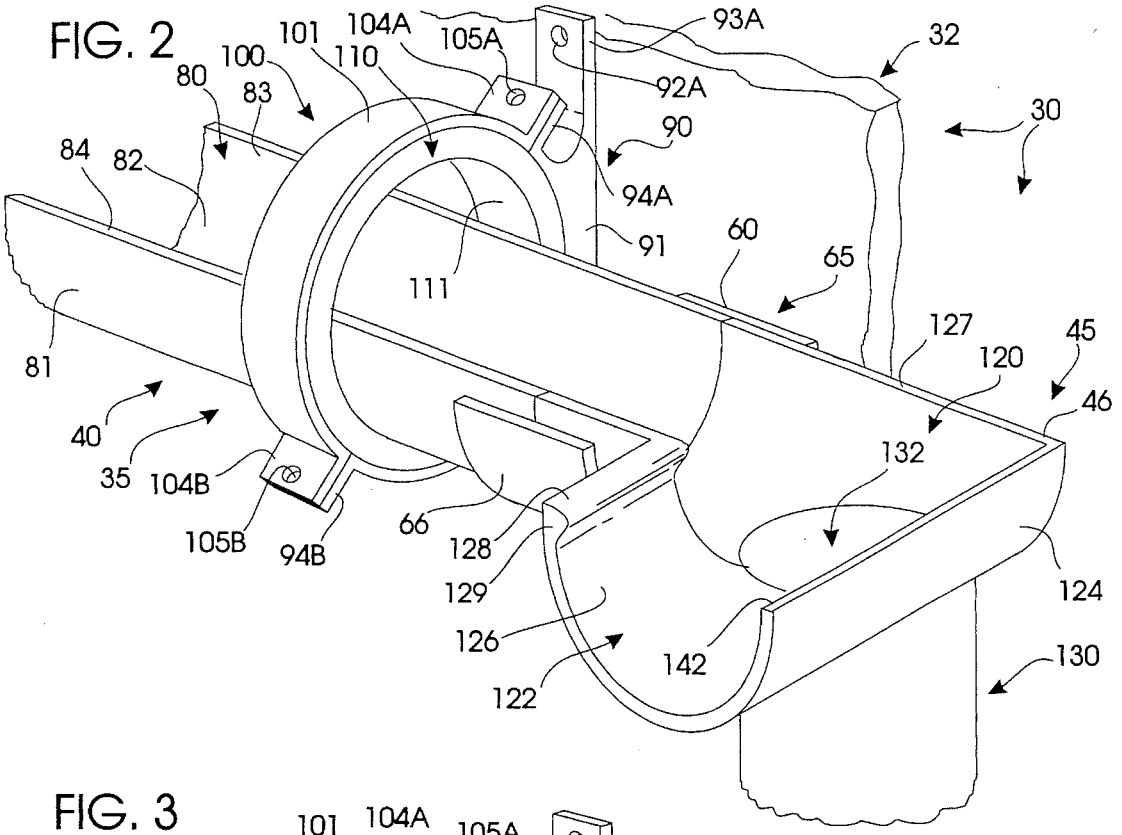
FIG. 2 is a greatly enlarged, fragmentary isometric view of the invention, with portions broken away or omitted for clarity.
Figure 3:
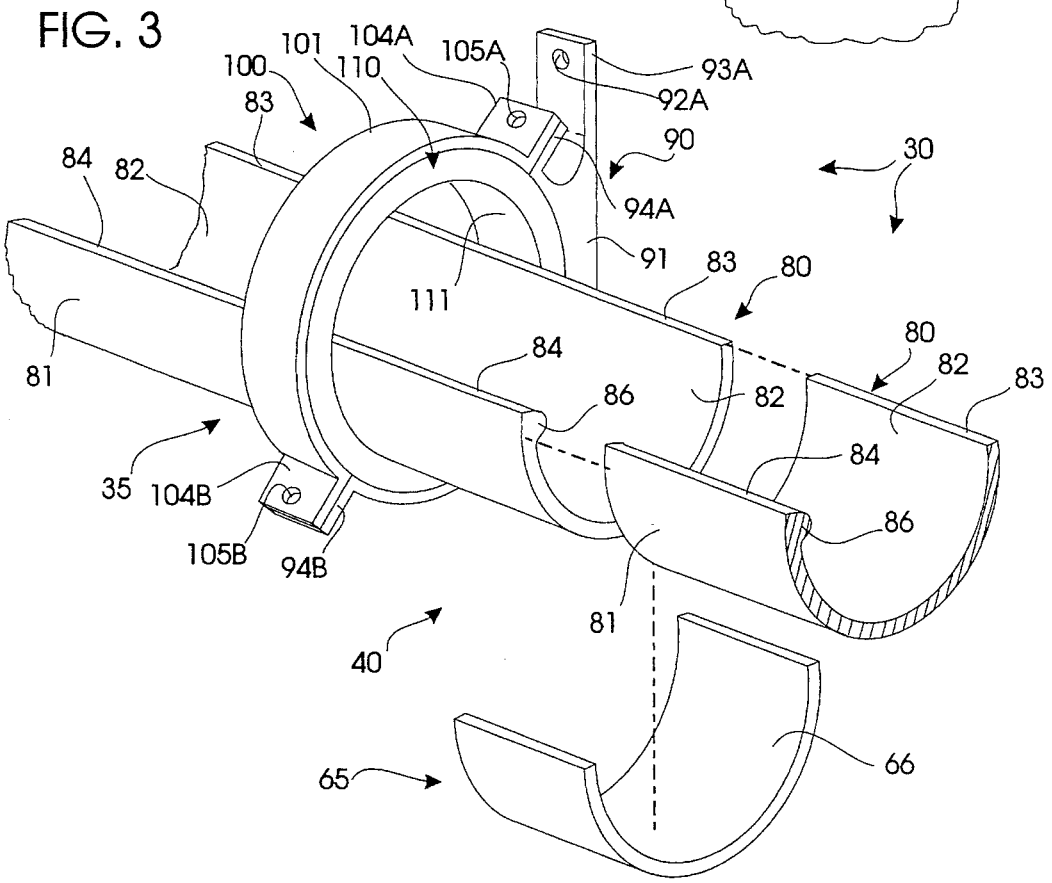
FIG. 3 is a greatly enlarged, partially exploded, fragmentary isometric view of the invention, with portions broken away or omitted for clarity.

Referring more specifically to the drawings, my quick cleaning gutter system is generally denoted by reference numeral 30. The gutter system 30 installs adjacent the roof 31 of a house (FIG. 1). A plurality of fixtures 35 mount the system 30 to the roof facia 32. A gutter shelf 33 extends from the bottom of the roof 31 to about the midpoint of the gutter to prevent ice and snow from damaging the gutter. During cold weather, the gutter is rotated to a dump position (FIG. 25) and the shelf facilitates the exit of snow and ice from the roof over the gutter. The shelf also helps to distribute exiting water evenly in the gutter system 30.

The gutter system 30 comprises a series of interconnected, open topped, semi-cylindrical gutter sections 40. Periodically, the gutter sections 40 intersect a downspout section 45 that provides a downward exit for the water flow. Preferably, the individual gutter sections 40 are installed at a slight, downwardly sloping angle or pitch between downspouts 45 to promote fluid flow thereto.

Figure 7:
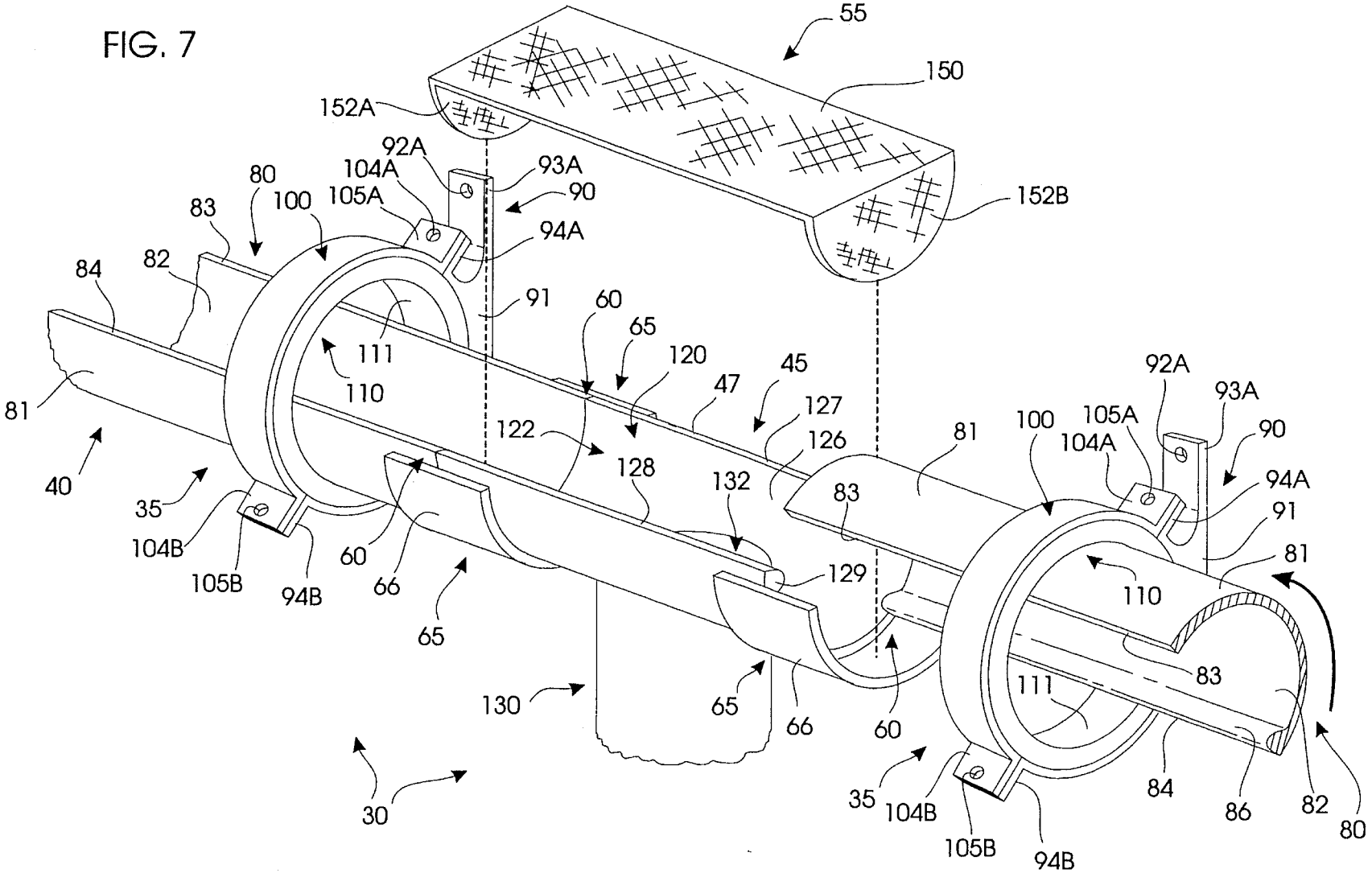
FIG. 7 is a greatly enlarged, exploded, fragmentary isometric view of the invention showing the rotation of a pipe, with portions broken away or omitted for clarity.
Figure 8:
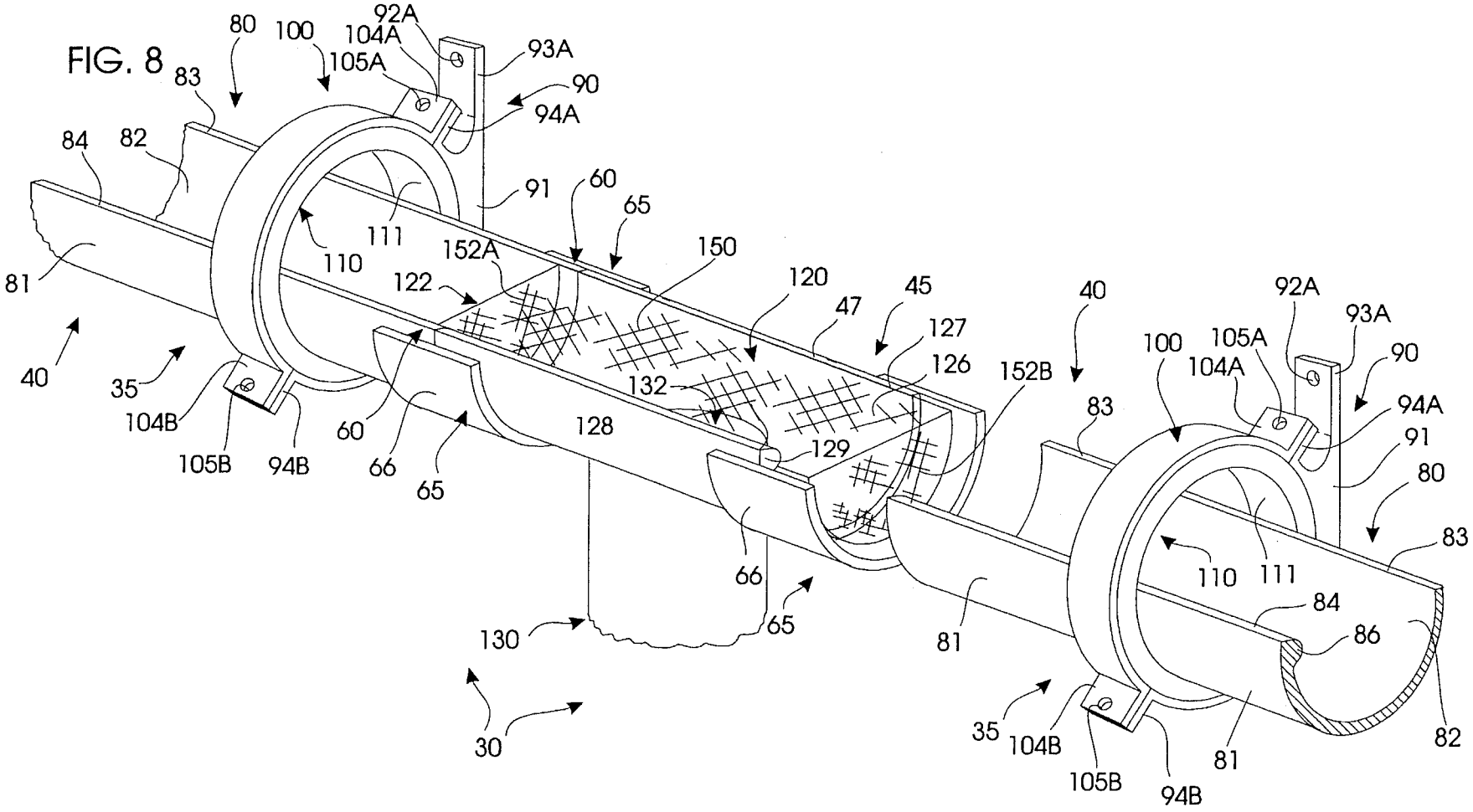
FIG. 8 is a greatly enlarged, fragmentary isometric view of the invention similar to FIG. 7, with portions broken away or omitted for clarity.
Figure 9:
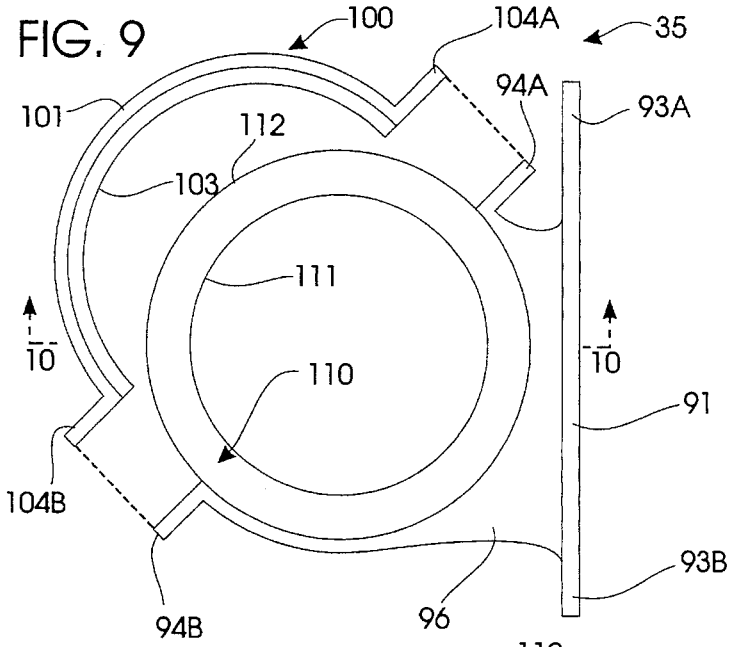
FIG. 9 is a greatly enlarged, exploded, side elevational view of a fixture.
Figure 10:
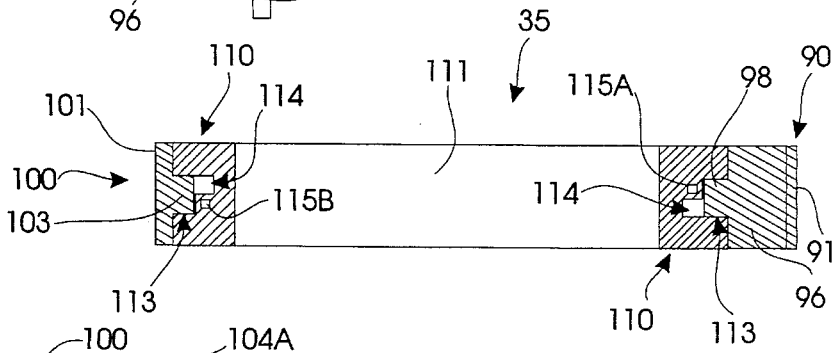
FIG. 10 is a cross-sectional view taken generally along line 10—10 of FIG. 9.

The downspout 45 may be located in an elbow 46 (FIGS. 1, 2, 4 and 6) or between two straight pipe sections in a straight junction 47 (FIGS. 7–8). The elbow sections 46 are used to facilitate installation of the gutter sections 40 around corners. Elbow 46 typically forms a ninety degree angle but may be formed at other conventional angles, e.g., forty-five degrees or thirty degrees. Straight junctions 47 are used to empty long gutter sections. The downspout section 45 empties into a drain pipe 50 that provides a fluid flow path for the water to exit the system at ground level in as desired.

A screen 55 prevents the entry of debris 70 into the downspouts 45 and drains 50. The screen 55 covers the area immediately adjacent to the downspout section 45. The screen 55 is conventionally attached to the downspout 45.

Figure 4:
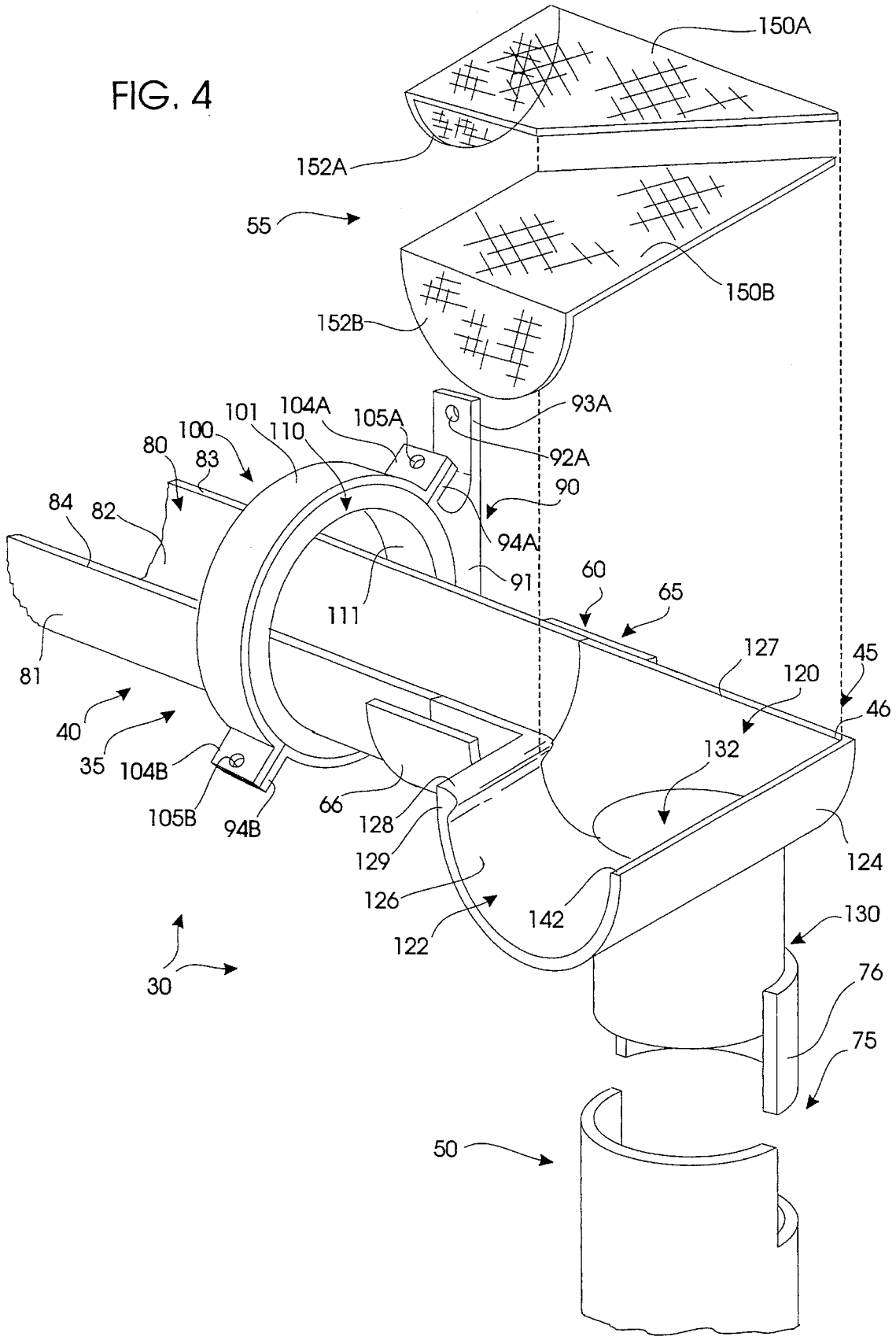
FIG. 4 is a greatly enlarged, partially exploded, fragmentary isometric view of the invention similar to FIG. 2, with portions broken away or omitted for clarity.
Figure 5:
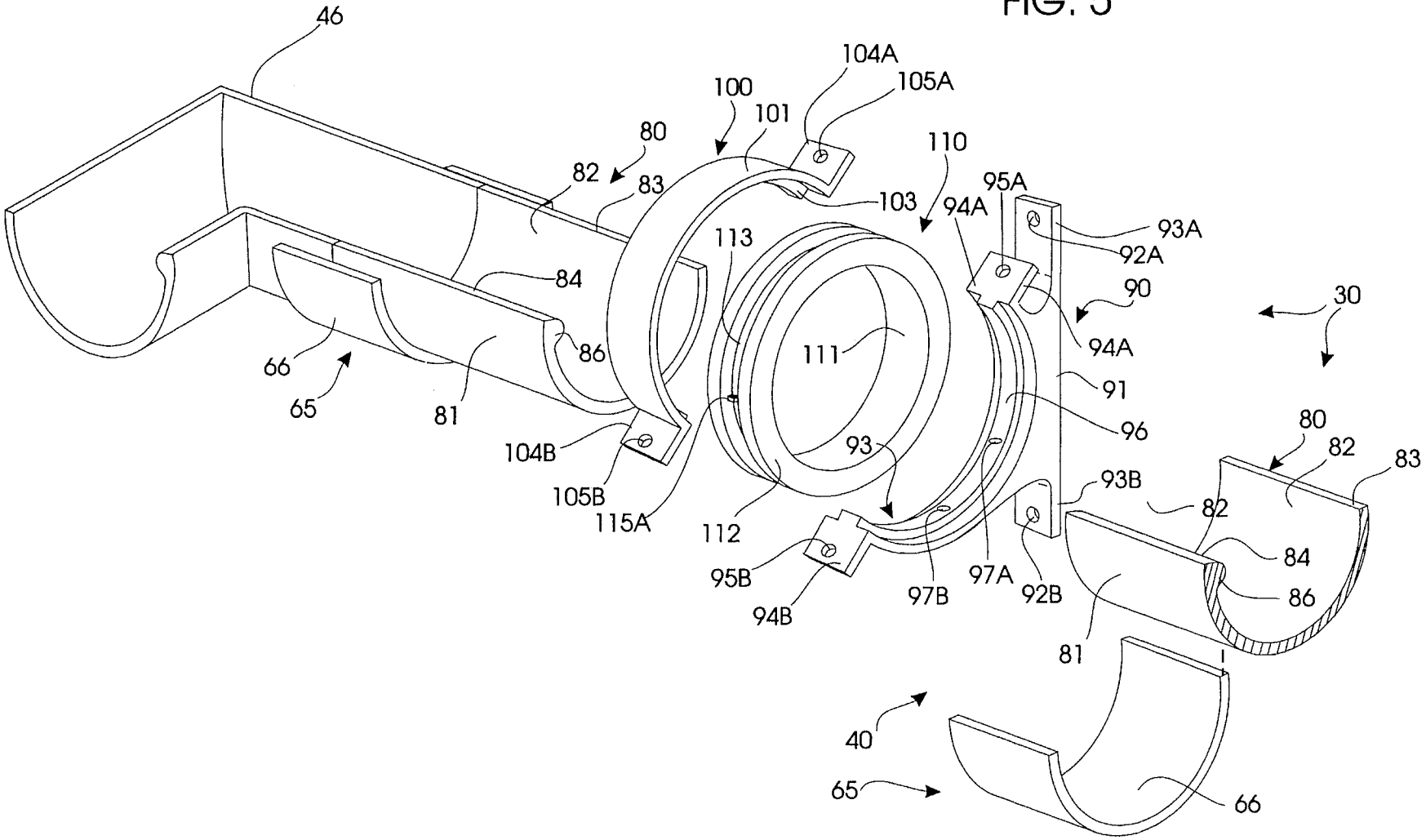
FIG. 5 is a greatly enlarged, exploded, fragmentary isometric view of the invention, with portions broken away or omitted for clarity.
Figure 6:
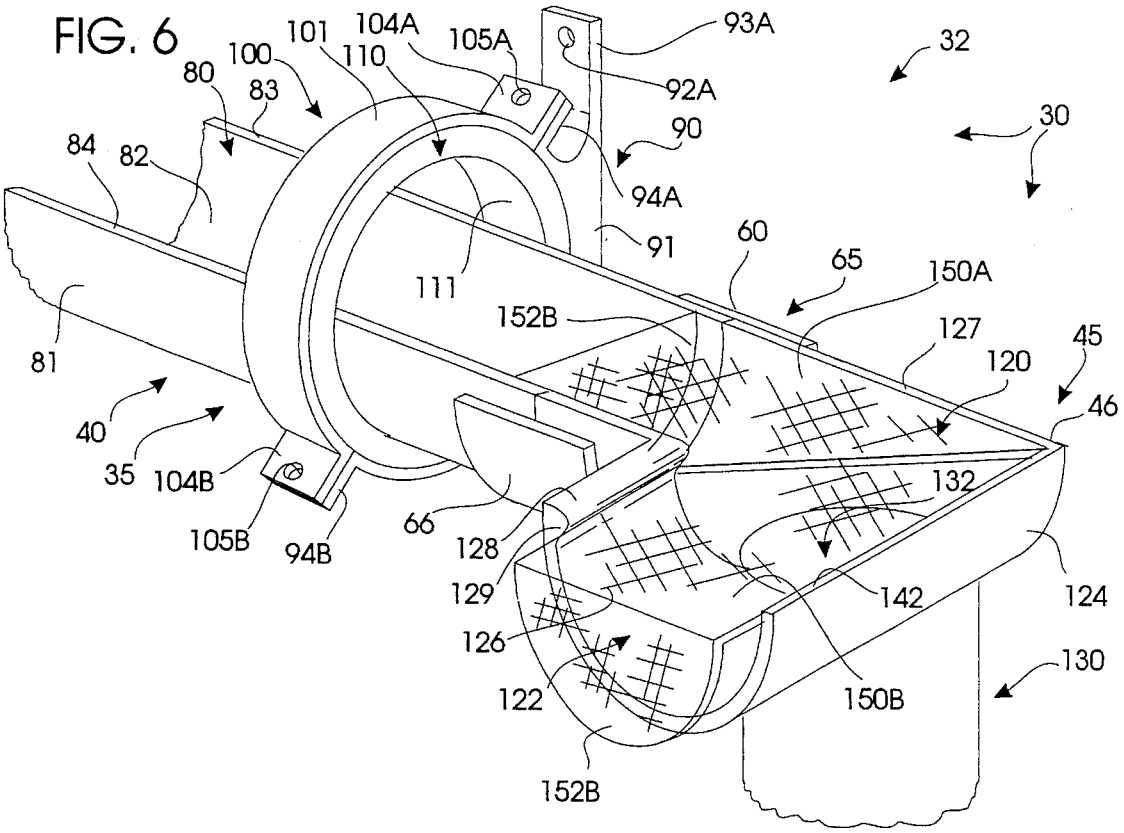
FIG. 6 is a greatly enlarged, fragmentary isometric view of the invention similar to FIGS. 2 and 4, with portions broken away or omitted for clarity.

In one alternative embodiment of the present invention, an alternative downspout 45A is shown which does not permanently attach to the drain pipe 50A (FIG. 4). Instead, the downspout section 45 is quick connected to the drain 50. The quick connect mating 75 comprises a semi-cylindrical skirt 76 having the same diameter as the drain pipe. The skirt 76 is affixed to the downspout 45. The skirt 76 permits the downspout 45 to rotate with the gutter section 40.

The junctures 60 between independent gutter sections 40 and gutter sections 40 and downspout sections 45 are sealed by connectors 65. The connectors 65 maintain fluid flow communication at the junctures 60. This prevents the egress of water therebetween while permitting rotary movement of the gutter sections 40.

The gutter sections 40 each comprise an open semi-cylindrical plastic tube or channel 80 (FIGS. 1–8). The channel 80 comprises an arcuate, convex outer surface 81 and a concave inner surface 82. The inner pipe edge 83 is installed adjacent the roof facia 32. The inner edge 83 is smooth and flat. The opposite, outer pipe edge 84 defines a hump or bead 86 that protrudes therefrom. The bead 86 functions as a splash guard and an accumulator. The bead 86 prevents the water from splashing out of the channel 80 during periods of heavy flow. The bead 86 also acts like an accumulator when the gutters are cleaned, as discussed more fully hereinafter.

The channel 80 is joined with adjacent structures, either pipes or downspout sections, by a connector 65. Connector 65 comprises a plastic shell 66 that has a slightly larger diameter than the plastic pipe or downspout section. The connecter 65 may be glued or otherwise conventionally attached to the plastic channel 80 to seal the junctures 60.

During installation, the connector 65 is joined only to adjacent rotating sections. In other words, if two plastic pipes are to be connected (FIG. 3), and both are to rotate simultaneously, the connector interior surface 67 is glued to both pipes. However if the pipes are to rotate separately (FIG. 7), it is necessary to glue the connector 65 to only one of the pipes. It is to be understood that the connector 65 may be glued to either of the pipes in the immediately preceding example.

The above installation procedure must also be followed when connecting a rotatable pipe 40 to a non-rotating downspout section 45 (FIGS. 1–2 and 6–8). The connector 65 cannot be connected to a rotatable and non-rotatable element because this would prevent the rotation of the gutter sections 40.

The gutter sections 40 are held to the roof by a several spaced-apart mounting fixtures 35 (FIG. 1). Each mounting fixture 35 comprises an attachment bracket 90 and a locking bracket 100 that captivate a collar 110 (FIGS. 5 and 9–11). The collar 110 secures the pipe to the mounting fixture 35. Channel 80 is glued or welded or otherwise conventionally attached to the collar 110.

The attachment bracket 90 comprises a flat, elongated wall 91. The wall 91 has two orifices 92A, 92B penetrating its upper and lower exterior ends 93A, 93B. The orifices 92A, 92B facilitate the attachment of the wall fixture with screws or nails or any other conventional method.

An arcuate cradle 96 stems outwardly from the wall 91 (FIGS. 9–16). A pair of outwardly extending flanges 94A, 94B emanate from the edges of the cradle 96. An arcuate tongue 98 projects outwardly from the interior surface of the cradle 93. A pair of spaced apart ellipsoidal orifices 97A, 97B penetrate the tongue 98 and the cradle 96.

The locking bracket 100 attaches to the mounting bracket 90 to captivate collar 110. The locking bracket 100 comprises an arcuate wall 101. An arcuate tongue 103 projects outwardly from the interior surface of the wall 101. A pair of outwardly extending flanges 104A, 104B mate with flanges 94A, 94B to mount the locking bracket to the wall bracket. A pair of orifices 105A, 105B align with orifices 95A, 95B and are penetrated by a nut and bolt or screw or similar conventional fastening means.

The collar 110 secures the channel 80 to the mounting fixture 35. The cylindrical collar 110 comprises an interior smooth, round surface 111 and an outer surface 112 (FIGS. 10 and 18–22). The outer surface 112 is cut by a groove 113 that circumscribes the surface 112. The tongue 98 mates inside the groove 113 to when the brackets 90, 100 are mated to form the overall bracket assembly. The tongue defines an interior race 114 inside channel 113. A pair of tie tabs 115A, 115B extend upwardly from the channel 113 to form alternate stops in the race 114.

Figure 11:
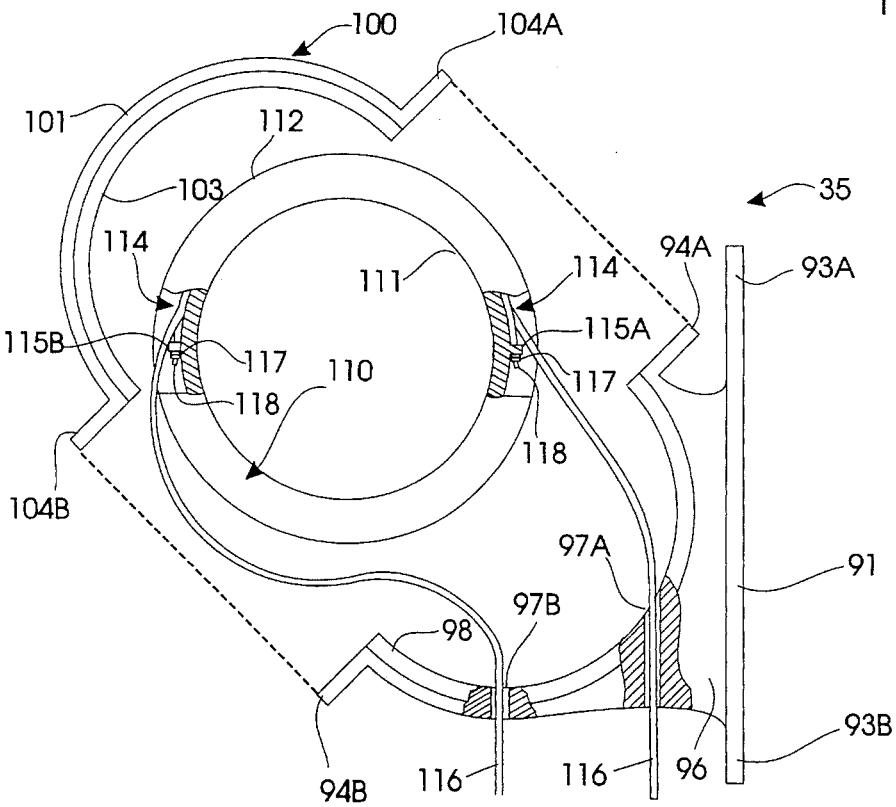
FIG. 11 is an exploded, fragmentary side elevational view of a fixture similar to FIG. 9, with portions shown in section for clarity.
Figure 12:
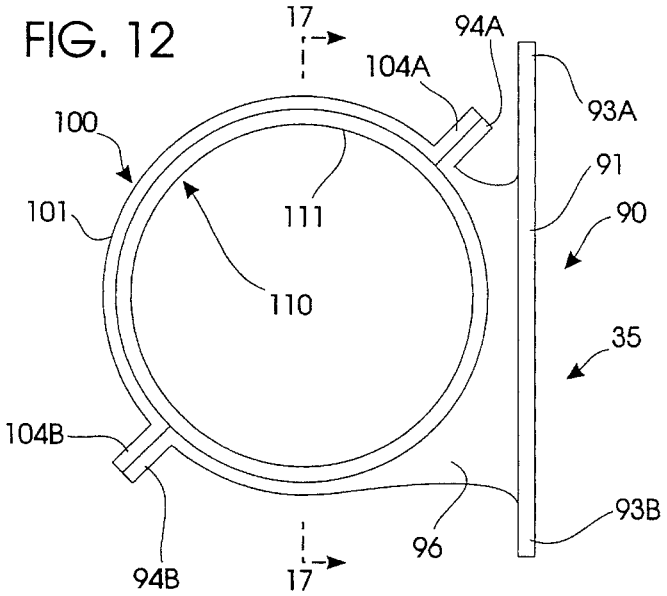
FIG. 12 is a greatly enlarged, side elevation view of a fixture similar to FIGS. 9 and 11.
Figure 13:
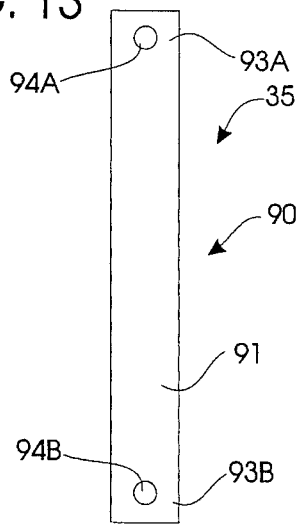
FIG. 13 is a greatly enlarged, rear elevational view of the fixture shown in FIG. 12.
Figure 14:
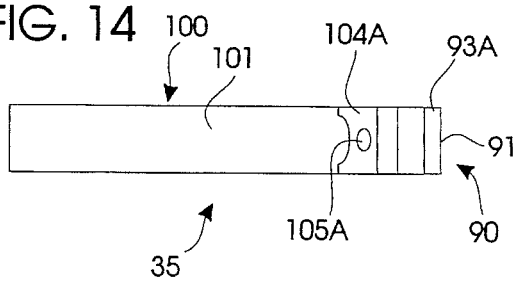
FIG. 14 is a greatly enlarged, top plan view of the fixture shown in FIG. 12.
Figure 15:
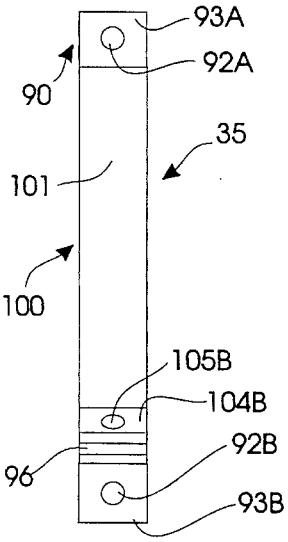
FIG. 15 is a greatly enlarged, front elevational view of the fixture shown in FIG. 12.
Figure 17:
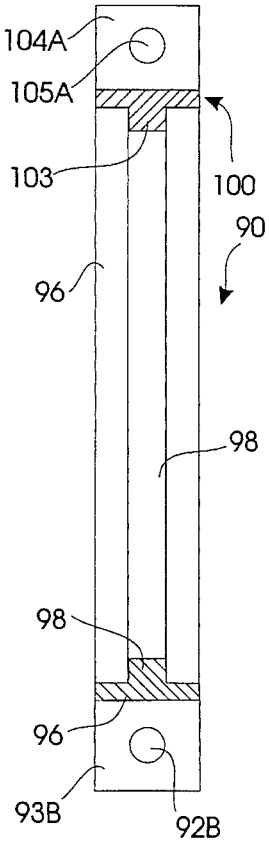
FIG. 17 is a cross-sectional view taken generally along line 17—17 of FIG. 12.
Figure 16:
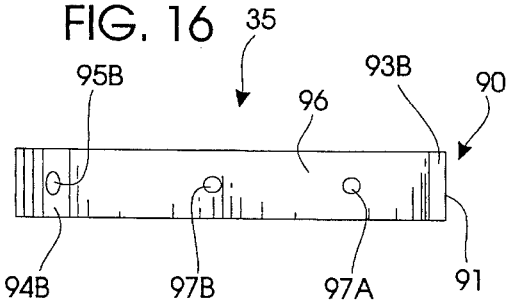
FIG. 16 is a greatly enlarged, bottom plan view of the fixture shown in FIG. 12.
Figure 18:
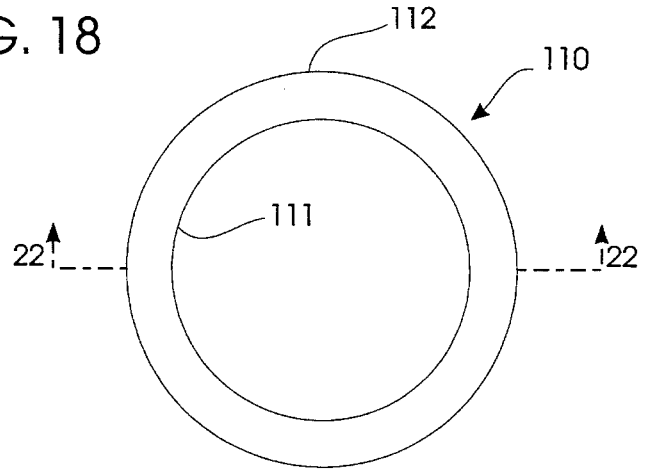
FIG. 18 is a greatly enlarged, side elevation view of a collar.
Figure 19:
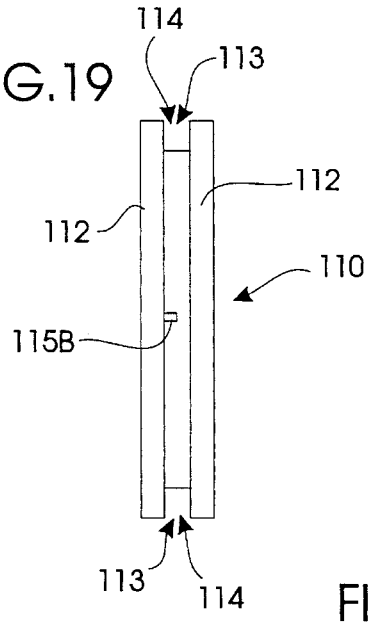
FIG. 19 is a greatly enlarged, front elevational view of the collar shown in FIG. 18.
Figure 20:
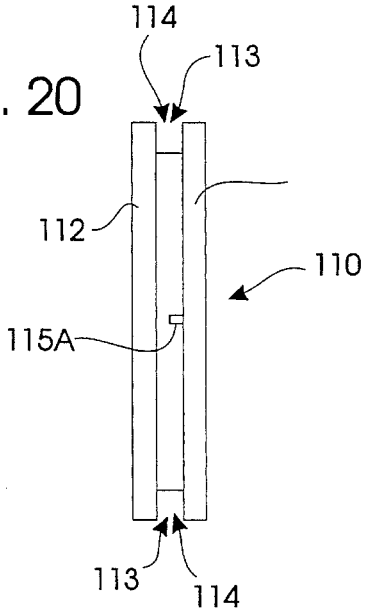
FIG. 20 is a greatly enlarged, rear elevational view of the collar shown in FIG. 18.
Figure 21:
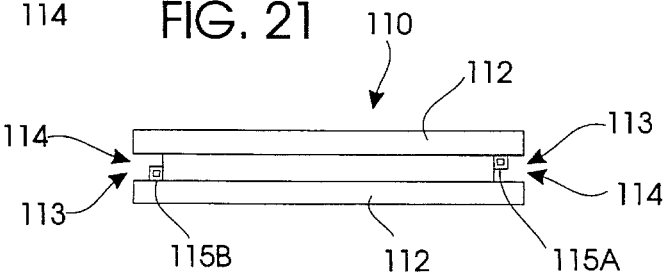
FIG. 21 is a greatly enlarged, top plan view of the collar shown in FIG. 18, the opposite view being a mirror image thereof.
Figure 22:
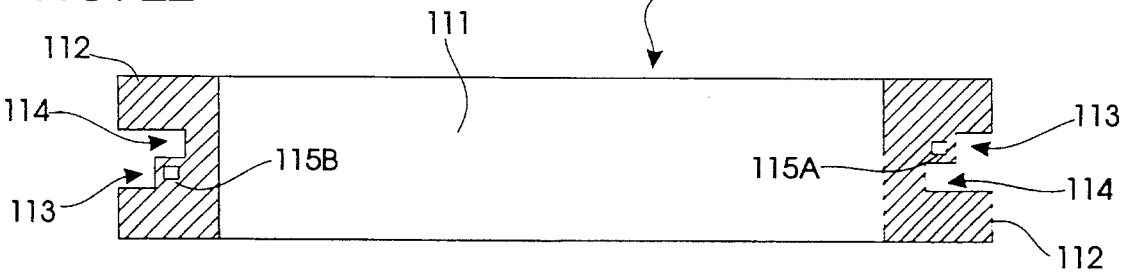
FIG. 22 is a cross-sectional view taken generally along line 22—22 of FIG. 18.

A cable 116 encircles the collar 110 (FIG. 11). The cable 116 ties to tabs 115A, 115B and the cable ends 118A, 118B are entrained about the race 114. The cable 116 extends to the ground to facilitate user manipulation of the system 30. A knot 117 is tied to each cable end 118A, 118B to retain the cable 116 to the collar 110. During cleaning operations, the user pulls the cable to empty debris 70 from the gutter system 30. The gutter sections 40 rotate to expel debris 70 outwardly, as discussed in more detail hereinafter. In one preferred embodiment, the downspout sections 45 do not rotate during cleaning operations. In one alternative embodiment, the downspout sections 45 rotate during cleaning operations.

The surfaces of the downspout sections 45 are similar to the surfaces of the channel 80. Each downspout section 45 generally comprises a horizontal upper portion 120 and a depending, vertically oriented lower portion 130. The upper portion 120 comprises an open, semi-cylindrical plastic channel or tube 122. The outer tube surface 124 is generally convex while the inner surface 126 is generally concave. The inner edge 127 is smooth and flat. The opposite, outer edge 128 defines a hump or bead 129 that protrudes therefrom.

The lower portion 130 depends from the upper portion 120. The lower portion 130 defines a conduit or exit 132 for the flow of water therethrough. The lower portion 130 conducts the flowing water downwardly into drain pipe 50. Thus, the downspout 45 redirects the fluid flow from a lateral direction along the roof edge to a vertical, downward direction to the base of the building. In most conventional installations, the diameter of the drain pipe exceeds the diameter of the downspout and the downspout is simply inserted into the drain pipe.

Screens 55 may be placed over the downspout sections 45 to prevent the entry of debris 70. The shape of a particular screen 55 depends upon the angular configuration of the covered downspout section 45. In other words, if the downspout section 45 is configured as a ninety degree elbow 46, then the screen 55 must be cut into two forty-five degree angle components or halves 150A, 150B. In a straight junction 47 (FIGS. 7 and 8), the screen 55 remains unitary.

The screen 55 comprises an elongated section 150 which bounded by ends 152A, 152B. The ends 152A, 152B are attached to the channel 80 like connectors 65. In other words, if the adjoining sections are designed to rotate in unison, the screen is attached to both members. Otherwise, it is only attached at one end, either 152A or 152B. If the screen 55 has been cut to fit an angled downspout section (FIG. 4 and 6), then both ends 152A, 152B are attached because the halves 150A, 150B of the screen will move independently.

OPERATION

Figure 23:
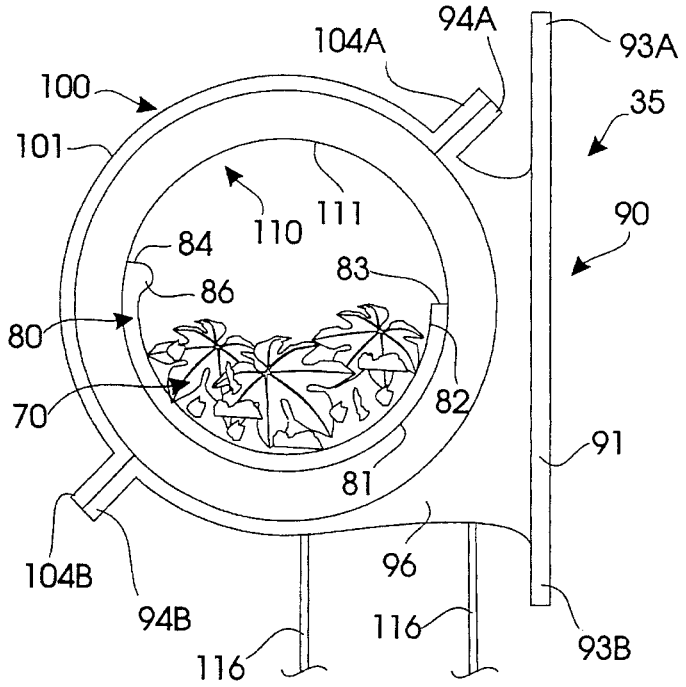
FIG. 23 is a greatly enlarged, side elevational view of the invention.
Figure 24:
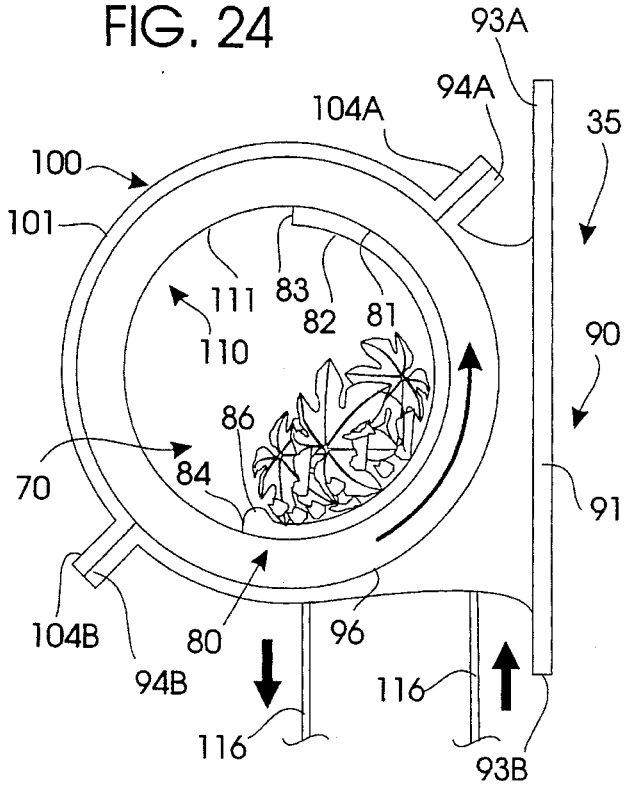
FIG. 24 is a greatly enlarged, side elevational view of the invention, showing the gutter in an initial rotary position; and, FIG. 25 is a greatly enlarged, partially fragmented, side elevational view of the invention, showing the gutter in a final rotary position expelling debris therefrom, with portions broken away or omitted for clarity.
Figure 25:
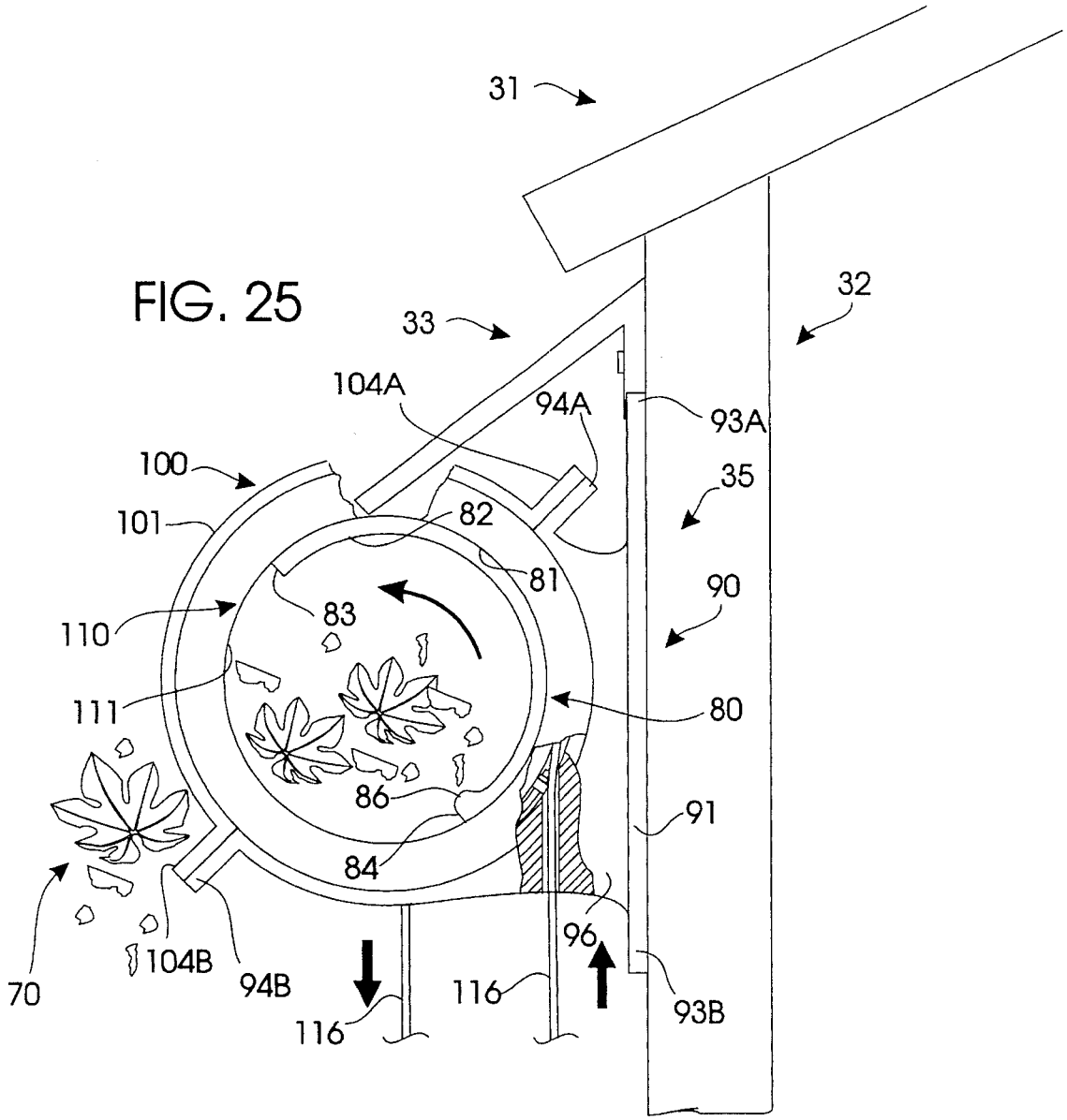

The operation of the quick cleaning gutter system 30 is best shown in FIGS. 23–25. An operator forcefully pulls the cable 116 in a continuous motion to rotate a gutter section 40. The gutter section 40 rotates to expel debris 70 therefrom, thus cleaning the gutter system 30.

The cable 116 is entrained in race 114 about the collar 110. The cable ends 118 are tied to the collar 110 at tabs 115A, 115B. The operator's pull forces the collar 110 to rotate in the bracket assembly formed by the mounting bracket 90 and locking bracket 100. The cable slides through the orifices 97A, 97B as the collar 110 rotates. The rotation of collar 110 also forces concurrent gutter 40 rotation.

As the gutter section 40 begins to rotate, the debris 70 accumulates adjacent bead 86. During subsequent rotation, the gutter section 40 holds the debris 70 adjacent the bead 86 because of the centrifugal forces developed by the rotary motion of the gutter 40.

The tabs 115A, 115B define stops in the race 114. In other words, the channel 114 ends at tabs 115A, 115B. Thus, when the tab 115B rotates to orifice 97A, the tab 115B immediately grabs the cable 116 entering channel 114, abruptly ceasing the rotary movement of the collar 110 and the gutter 40.

When channel rotation ensues, debris is accelerated. The now-moving debris is ejected or thrown from the channel in response to abrupt cessation of rotary movement. The ejection forces propel the debris outwardly and away from the gutter, initially following the interior curvature of channel 80. The debris 70 is expelled outwardly from the gutter 40, assuming an arcuate, downward path. Ejection in this manner propels the debris away from the user.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A quick cleaning gutter system selectively tilting to expel debris from gutters, said gutter system collecting water flowing off a building roof and channeling water to the ground, said system comprising:

at least one elongated channel having a generally semi-circular cross section;

mounting means for suspending said gutter adjacent said roof, said mounting means penetrated by two spaced-apart orifices and said mounting means comprising:

collar means for securing said channel, said collar means rotatably captivated within said mounting means;

a fixture adapted to be secured to said building, said fixture comprising an integral, outwardly facing cradle and a removable bracket adapted to be coaxially coupled to said cradle about said collar means, said bracket and said cradle having mating, interior semicircular faces that form a circle when the mounting means is assembled;

tongue means protruding from said interior faces of said bracket and said cradle;

groove means circumscribing the exterior surface of said collar means;

cable means extending through said orifices and at least partially entrained about said collar means for rotating said collar means to rotate said channel;

a downspout coupled to said channel for exiting water therefrom; and, a drain beneath said downspout in fluid flow communication therewith, said drain extending downwardly.

2. The gutter system as defined in claim 1 further comprising shelf means for protecting said system.

3. The gutter system as defined in claim 2 further comprising means for ejecting debris from said system in response to channel rotation.

4. A quick cleaning gutter system for buildings, said system comprising:

a least one elongated plastic channel having a generally semi-circular cross section, said channel collecting water exiting the roof of said building;

mounting means for suspending said channel adjacent said roof, said mounting means comprising:

collar means for securing said channel, said collar means rotatably captivated within said mounting means;

a fixture adapted to be secured to said building, said fixture comprising an integral, outwardly facing cradle and a removable bracket adapted to be mated to said cradle to axial captivate said collar means and thus said channel, said bracket and said cradle have mating, interior semicircular faces that form a circle when the mounting means is assembled;

tongue means and groove means associated with said mounting means for facilitating rotation between said collar means and said mounting means while preventing axial displacements therebetween, said tongue means protruding from the interior faces of said bracket and said cradle and said groove means circumscribing the exterior surface of said collar means; and, means for rotating said collar means to turn the channel over facilitating the removal of accumulate debris.

5. The gutter system as defined in claim 4 wherein said means for rotating said collar means comprises cable means entrained about said collar means at least partially within said groove means for rotating said collar means.

6. The gutter system as defined in claim 5 wherein said fixture further comprises passageways for directing said cable means downwardly.

7. A quick cleaning gutter system for removing debris from gutters, said gutter system collecting water flowing off a building roof and channeling water to the ground, said system comprising:

at least one elongated channel having a generally semi-circular cross section;

mounting means for suspending said gutter adjacent said roof, said mounting means comprising:

collar means for securing said channel, said collar means rotatably captivated within said mounting means;

a fixture adapted to be secured to said building, said fixture comprising an integral, outwardly facing cradle and a removable bracket adapted to be coaxially coupled to said cradle about said collar means, said bracket and said cradle have mating, interior semicircular faces that form a circle when the mounting means is assembled;

tongue means and groove means associated with said mounting means for facilitating rotation between said collar means and said mounting means, said tongue means protruding from the interior faces of said bracket and said cradle and said groove means circumscribing the exterior surface of said collar means;

means for rotating said collar means to empty said gutters;

a downspout coupled to said channel for exiting water therefrom; and, a drain beneath said downspout in fluid flow communication therewith, said drain extending downwardly.

8. The gutter system as defined in claim 7 herein said means for rotating said collar means comprises cable means at least partially entrained about said collar means for rotating said collar means.

9. The gutter system as defined in claim 8 wherein said fixture further comprises passageways for guiding said cable means.

10. The gutter system as defined in claim 7 further comprising quick-release means for coupling said downspout in fluid flow communication with said drain thereby freeing the downspout from the drain during rotation of said channel.

11. The gutter system as defined in claim 10 wherein said quick-release means comprises a semicylindrical skirt attached to the exterior surface of said downspout, said skirt adapted to temporarily seal said downspout to said drain.

12. The gutter system as defined in claim 7 further comprising screen means for preventing the entry of debris into said downspout.

13. The gutter system as defined in claim 7 further comprising elbow means for changing the longitudinal orientation of said gutter.

* * * * *